US005262147A

United States Patent [19]

Miyata

[11] Patent Number: 5,262,147

[45] Date of Patent: Nov. 16, 1993

[54] BASIC COMPOSITE METAL SULFATE FIBER, PROCESS FOR THE PRODUCTION THEREOF, AND COMPOSITION CONTAINING THE SAME

[75] Inventor: Shigeo Miyata, Takamatsu, Japan

[73] Assignee: Kabushiki Kaisha Kaisui Kagaku Kenkyujo, Kagawa, Japan

[21] Appl. No.: 873,214

[22] Filed: Apr. 24, 1992

[30] Foreign Application Priority Data

Apr. 26, 1991 [JP] Japan ..... 3-124758

[51] Int. Cl.[5] ..... C01F 5/40

[52] U.S. Cl. ..... 423/554; 423/544; 423/548; 423/592; 106/419; 106/456; 106/461; 106/480

[58] Field of Search ..... 423/544, 548, 554, 592; 524/432, 423, 433; 106/419, 456, 461, 480

[56] References Cited

U.S. PATENT DOCUMENTS

| | | | |
|---|---|---|---|
| 3,137,958 | 8/1992 | Matsunami et al. | 524/405 |
| 4,427,816 | 1/1984 | Aoki et al. | 524/357 |
| 4,675,356 | 6/1987 | Miyata | 524/424 |
| 4,761,188 | 8/1988 | Miyata | 148/6.2 |
| 4,997,871 | 3/1991 | Ueno et al. | 524/423 |
| 5,036,127 | 7/1991 | Ueno et al. | 524/423 |
| 5,169,892 | 12/1992 | Kawashima et al. | 524/394 |

FOREIGN PATENT DOCUMENTS 56-149318 11/1981 Japan .

OTHER PUBLICATIONS

Ube Industries, Chemical Abstracts, vol. 91, No. 20 May, 1982 Abstract No. 165000v, Abstract of JP-A-56 149 318.

*Primary Examiner*—Gary P. Straub
*Assistant Examiner*—Timothy C. Vanoy
*Attorney, Agent, or Firm*—Wenderoth, Lind & Ponack

[57] ABSTRACT

A novel basic composite metal sulfate fiber, a process for the production thereof, and a resin and/or rubber composition which contains the basic composite metal sulfate fiber and gives a molded article which is improved in mechanical strength and/or flame retardancy and having an excellent appearance. The basic composite metal sulfate fiber has the formula (1), $$(Mg_{1-x}M^{2+}{}_x)_6(OH)_{12-2y}(SO_4{}^{2-})_y \cdot mH_2O \quad (1)$$

wherein M is at least one metal selected from the group consisting of Mn, Fe, Co, Ni, Cu and Zn, and x, y and m are respectively defined by $0.005<x<0.5$, $0.8<y<1.2$ and $0<m<4$.

7 Claims, No Drawings

BASIC COMPOSITE METAL SULFATE FIBER, PROCESS FOR THE PRODUCTION THEREOF, AND COMPOSITION CONTAINING THE SAME

FIELD OF THE INVENTION

The present invention relates to a novel basic composite metal sulfate fiber, a process for the production thereof, and a resin and/or rubber composition which contains the basic composite metal sulfate fiber and gives a molded article which is improved in mechanical strength and/or flame retardancy and having an excellent appearance.

PRIOR ART OF THE INVENTION

A basic magnesium sulfate fiber of the following composition formula (3), $$Mg_6(OH)_{10}SO_4.nH_2O \quad (3)$$

is well known (for example, see JP-A-56-149318, JP-A-1-126218 and JP-A-1-126219). When this basic magnesium sulfate fiber is incorporated into a resin such as polypropylene, the resultant composition shows improvement in tensile strength, flexural strength and flexural modulus. Further, the above basic magnesium sulfate fiber is a fine fiber having a diameter of 10 μm or less and a length of 1,000μ or less. Hence, unlike a molded article formed from a resin containing a coarse and large glass fiber, a molded article formed from a resin containing the above basic magnesium sulfate fiber is free from surface roughness. Therefore, such a basic magnesium sulfate fiber is expected to be useful as a material in the fields of automobiles, electric products and furniture.

However, the basic magnesium sulfate fiber of the above formula (3) has the following problem; it starts to release crystal water, which is represented by $nH_2O$ in the above formula (3), at a temperature of about 200° C. As a result, when a resin composition containing the basic magnesium sulfate fiber is molded at a molding temperature of generally used resins, i.e., 200° C. or higher, the resultant molded article shows a silver streak or a flow mark on the surface, that is, a defective appearance is caused.

Meanwhile, in addition to the use for strength reinforcement, the above basic magnesium sulfate fiber is sometimes used as a flame retardant in combination with magnesium hydroxide. However, the temperature at which the basic magnesium sulfate of the formula (3) is condensed and dehydrated to form water from structural water (OH group) is about 445° C., and this temperature is higher than the dehydration temperature, about 430° C., of magnesium hydroxide useful as a flame retardant. Therefore, the dehydration (endothermic reaction) temperature of the above basic magnesium sulfate is consequently higher than the ignition (exothermic reaction) temperature of resins such as polypropylene. That is, the flame-retardant effect of the basic magnesium sulfate is inferior to the effect of magnesium hydroxide. Moreover, the above basic magnesium sulfate is poor in acid resistance.

SUMMARY OF THE INVENTION

It is an object of the present invention to provide a novel fiber which is capable of improving a resin and/or rubber in mechanical strength and/or flame retardancy.

It is another object of the present invention to provide a resin and/or rubber composition which gives a molded article which is improved in mechanical strength and/or flame retardancy and having an excellent appearance.

It is further another object of the present invention to provide a process for producing the above fiber.

According to the present invention, there is provided a basic composite metal sulfate fiber having the formula (1), $$(Mg_{1-x}M^{2+}{}_x)_6(OH)_{12-2y}(SO_4{}^{2-})_y.mH_2O \quad (1)$$

wherein M is at least one metal selected from the group consisting of Mn, Fe, Co, Ni, Cu and Zn, and x, y and m are respectively defined by $0.005<x<0.5$, $0.8<y<1.2$ and $0<m<4$.

According to the present invention, there is also provided a resin and/or rubber composition containing 100 parts by weight of a resin and/or rubber and approximately 1 to 100 parts by weight of the above basic composite metal sulfate fiber.

According to the present invention, there is further provided a process for the production of the above basic composite metal sulfate fiber, which comprises adding at least one alkali selected from the group consisting of $Mg(OH)_2$, MgO, ammonia and alkali metal hydroxide to a mixed aqueous solution containing magnesium sulfate and sulfate of at least one divalent metal selected from the group consisting of Mn, Fe, Co, Ni, Cu and Zn, the amount of the alkali(s) being not more than approximately 50 mol % based on the total molar weight of the magnesium sulfate and the divalent metal(s), and allowing the resultant mixture to hydrothermally react approximately at a temperature between 110° C. and 300° C.

DETAILED DESCRIPTION OF THE INVENTION

The present invention has made a diligent study to overcome the above problems, and found the basic composite metal sulfate fiber of the formula (1). The present inventor has found that the basic composite metal sulfate fiber of the present invention has the following properties; that is, the elimination initiation temperature of crystal water present as $mH_2O$ in the formula (1) is higher than that of crystal water in the conventional basic magnesium sulfate fiber of the formula (3), and at the same time, the dehydration temperature of structural water in the formula (1), which produces a flame-retardant effect, is lower than that of structural water of the basic magnesium sulfate fiber of the formula (3).

Differing to some extent depending upon the kind of $M^{2+}$ in the formula (1), the above tendencies to an increase in the elimination initiation temperature of crystal water and to a decrease in the dehydration temperature of structural water are nearly in proportion to an increment of $M^{2+}$.

The increase in the elimination initiation temperature means widening of the temperature range in which a resin and/or rubber can be molded without causing a defective appearance on a molded article. That is, the basic composite metal sulfate fiber of the present invention can be incorporated into a wider range of resins, since the molding temperature can be set at a temperature higher than 200° C. Further, the basic composite metal sulfate fiber of the present invention works to produce a flame-retardant effect due to the dehydration of structural water similarly to magnesium hydroxide, and the effect thereof as a flame retardant is high. Further, since $M^{2+}$ in the formula (1) has a catalytic action to promote the carbonization of a resin or rubber, the basic composite metal sulfate fiber of the present invention exhibits an excellent flame-retardant effect over the conventional basic magnesium sulfate fiber. The conventional basic magnesium sulfate fiber has poor acid resistance, while the basic composite metal sulfate fiber of the formula (1) in which M is Ni or Co particularly produces an effect that the acid resistance is remarkably improved.

The basic composite metal sulfate fiber of the present invention has a diameter of approximately 0.01 to 10 μm and a length of approximately 5 to 1,000 μm, and preferably has a diameter of 0.1 to 1 μm and a length of 10 to 100 μm. Moreover, it has a length/diameter aspect ratio of not less than 50. The above values are determined with a scanning electron microscope.

The basic composite metal sulfate fiber of the present invention shows substantially the same powder X-ray diffraction pattern as that of the conventional basic magnesium sulfate (ASTM 7-415, 13-340), and it is therefore assumed that $M^{2+}$ is dissolved in Mg. In the formula (1), therefore, the range of x shows an amount of $M^{2+}$ dissolved in Mg. When x is less than 0.005, the degrees of the increase in the elimination initiation temperature of crystal water and the decrease in the dehydration temperature of structural water (hydroxyl group) are very small. When x is more than 0.5, a fibrous crystal is hardly formed. The range of x is preferably 0.01 to 0.4.

The basic composite metal sulfate fiber of the present invention is produced as follows.

At least one alkali selected from the group consisting of $Mg(OH)_2$, MgO, ammonia and alkali metal hydroxide, preferably $Mg(OH)_2$ or MgO, is added to a mixed aqueous solution containing magnesium sulfate and sulfate of at least one metal (referred to as $M^{2+}$ in the formula (1)) selected from the group consisting of Mn, Fe, Co, Ni, Cu and Zn. In this case, the amount of the alkali(s) to be added is approximately not more than 50 mol % based on the total molar amount of the magnesium sulfate and $M^{2+}$. Then, the above-prepared mixture is subjected to hydrothermal treatment in an autoclave at a temperature approximately between 110° C. and 300° C. for approximately 1 to 50 hours in the presence or absence of the basic magnesium sulfate fiber of the formula (3) or a basic composite metal sulfate fiber of the present invention, preferably, in the presence of a basic composite metal sulfate fiber of the present invention. In addition to the above alkali(s), there may be added at least one composite metal hydroxide of those of the formula (2), $Mg_{1-z}M^{2+}_z(OH)_2$, in which M has the same meaning as that of M in the formula (1) and z is defined by $0.005<z<0.9$.

In order to produce a fiber having a high aspect ratio, it is preferred to set the concentration of the above metal sulfates at a higher value, and it is also preferred to set the amount of the alkali(s) at approximately not more than 30 mol %. With an increase in the hydrothermal treatment temperature, the reaction time can be decreased, and the growth of the fiber tends to be improved. However, when the hydrothermal treatment temperature exceeds 250° C., the elimination of crystal water undesirably starts. The hydrothermal treatment temperature is preferably in the range of approximately 140° to 250° C.

The basic magnesium sulfate fiber which is preferably used in the present invention can be produced by the method described in JP-A-56-149318.

The basic composite metal sulfate fiber of the present invention may be used as a reinforcing material and/or a flame retardant without any modification. Further, it may be surface-treated with a surface treating agent. The surface treating agent comprises at least one selected from higher fatty acid, anionic surfactant, phosphate ester, silane-based, a titanium-based or aluminum-based coupling agent and esters formed from polyhydric alcohols and fatty acids.

Specific examples of the surface treating agent preferably include higher fatty acids having at least 10 carbon atoms such as stearic acid, oleic acid, erucic acid, palmitic acid, lauric acid and behenic acid; sulfates of higher alcohols such as stearyl alcohol and oleyl alcohol; sulfate of polyethylene glycol ether; amide-bond sulfates; anionic surfactants such as ester-bond sulfates; ester-bond sulfonates, amide-bond sulfonates, ether-bond sulfonates, ether-bond alkylallylsulfonates, ester-bond alkylallylsulfonate and amide-bond alkylallylsulfonates; phosphate esters such as mono- or diesters formed from orthophosphate and higher alcohols such as oleyl alcohol and stearyl alcohol or a mixture of these, which are acid type, alkali metal salt type or amine salt type phosphate esters; silane-coupling agents such as vinylethoxysilane, vinyl-tris(2-methoxyethoxy)silane, gamma-methacryloxypropyltrimethoxysilane, gamma-aminopropyltrimethoxysilane, beta-(3,4-epoxycyclohexyl)ethyltrimethoxysilane, gamma-glycidoxypropyltrimethoxysilane and gamma-mercaptopropyltrimethoxysilane; titanate-based coupling agents such as isopropyltriisostearoyltitanate, isopropyltris(dioctylpyrophosphate)titanate, isopropyltri(N-aminoethyl-aminoethyl)titanate and isopropyltridecylbenzenesulfonyltitanate; aluminum-based coupling agents such as acetalkoxyaluminumisopropylate; and esters formed from polyhydric alcohols and fatty acids such as glycerin monostearate and glycerin monoolelate.

The basic composite metal sulfate fiber of the formula (1) may be surface-coated with the surface-treating agent by a known wet or dry method. For example, in the wet method, the surface treating agent in a liquid or emulsion state is added to a slurry of the basic composite metal sulfate fiber, and these are mechanically fully mixed at a temperature of up to about 100° C. In the dry method, the surface treating agent in a liquid, emulsion or solid state is added to a powder of the basic composite metal sulfate fiber while the powder is fully stirred with a mixing device such as a Henschel mixer, and these are fully mixed with or without heating. The amount of the surface treating agent for use can be properly selected. In general, it is preferably about 0.1 to about 10% by weight. The surface-treated basic composite metal sulfate fiber is optionally washed with water, dehydrated, granulated, dried, pulverized, and classified to obtain a final product.

Examples of the resin and rubber used in the present invention include polyethylene, a copolymer from ethylene and other α-olefin, a copolymer from ethylene and vinyl acetate, methyl acrylate or ethyl acrylate, polypropylene, a copolymer from propylene and other α-olefin, polybutene-1, polystyrene, a copolymer from styrene and other acrylonitrile, a copolymer from ethylene and propylene diene rubber or butadiene, thermoplastic resins such as vinyl acetate, polyacrylate, polymethacrylate, polyurethane, polyester, polyether and polyamide, thermosetting resins such as phenolic resin, melamine resin, epoxy resin, unsaturated polyester resin and alkyd resin, EPDM, SBR, NBR, butyl rubber, isoprene rubber, and chlorosulfonated polyethylene, although the resin and the rubber used in the present invention shall not be limited to these.

The resin and/or rubber composition of the present invention differs depending upon the kind of resin and/or rubber. The resin and/or rubber composition generally contains 100 parts by weight of the above resin and/or the above rubber and approximately 1 to 100 parts by weight, preferably, approximately 5 to 70 parts by weight of the surface-treated or surface-untreated basic composite metal sulfate fiber of the formula (1). When the amount of the basic composite metal sulfate fiber is less than the above lower limit, effects on reinforcement and flame retardancy can be hardly obtained. When this amount exceeds the above upper limit, the resultant composition disadvantageously tends to show poor processability and moldability. Further, the Izod impact strength disadvantageously tends to decrease.

The resin and/or rubber and the basic composite metal sulfate fiber can be kneaded by any method and any means that permits homogeneous mixing of these components. For example, a single-screw or twin-screw extruder, a roll and a Banbury mixer may be used. The resin and/or rubber composition may be molded by any molding method that is known per se. For example, there may be employed an injection molding method, an extrusion method, a blow molding method, a press molding method, a rotational molding method, a calendering method, a sheet forming method, a transfer molding method, a laminated molding method and a vacuum forming method.

The resin and/or rubber composition of the present invention optionally contains other additives in addition to the basic composite metal sulfate fiber. For example, there may be incorporated flame retardants such as magnesium hydroxide and aluminum hydroxide. The amount of these flame retardants is preferably approximately 50 to 200 parts by weight per 100 parts by weight of the resin and/or rubber.

Further, the resin and/or rubber composition of the present invention may contain a flame retardant auxiliary containing at least one of a carbon powder, ferrocene, anthracene, polyacetylene, red phosphorus, an acrylic fiber and nickel oxide. The amount of the flame retardant auxiliary is preferably approximately 0.1 to 10 parts by weight per 100 parts by weight of the resin and/or rubber.

The resin and/or rubber composition of the present invention may further contain other conventional additives such as an antioxidant, an ultraviolet light absorber, a lubricant, an antistatic agent, a pigment, a foaming agent, a plasticizer, a filler, an organohalogen flame retardant and a crosslinking agent.

The present invention will be detailed hereinafter by reference to Examples, in which "part" and "%" stand for "part by weight" and "% by weight" unless otherwise specified.

EXAMPLE 1

Nickel sulfate (0.01 mol) was dissolved in 2 liters of an aqueous solution containing 1.5 mol/l of magnesium sulfate, and then 3 g of a basic magnesium sulfate fiber and 26.3 g of a magnesium hydroxide powder (the amount corresponding to 15 mol % based on the total molar amount of the magnesium sulfate and nickel sulfate) were added and homogeneously dispersed with a stirrer. The resultant slurry was placed in an autoclave having a volume of 3 liters and hydrothermally treated at 170° C. for 7 hours. The reaction mixture was taken out, and filtered under reduced pressure, and the remainder was washed with water, dehydrated and dried to give a basic composite metal sulfate fiber. The above basic magnesium sulfate fiber and those magnesium sulfate fibers used in Examples which will follow hereinafter were prepared in Control Example which will follow later.

The above-obtained basic composite metal sulfate fiber was measured for a crystal phase by powder X-ray diffraction, for an average diameter and an average length with a scanning electron microscope, for temperatures of dehydration of crystal water and structural water by differential thermal analysis (DTA)—thermal gravimetric analysis (TGA), and for a composition by chemical analysis.

The above basic composite metal sulfate fiber had the following composition.

$$(Ni_{0.01}Mg_{0.99})_6(OH)_{10.12}(SO_4)_{0.94}\cdot 2.0H_2O.$$

Table 1 shows the other measurement results.

EXAMPLES 2 AND 3

Example 1 was repeated except that 0.08 mol of nickel sulfate (Example 2) or 0.27 mol of nickel sulfate (Example 3) was dissolved in 2 liters of an aqueous solution containing 1.5 mol/liter of magnesium sulfate to give basic composite metal sulfate fibers. The so-obtained basic composite metal sulfate fibers were measured for a crystal phase, an average diameter, an average length and temperatures of dehydration of crystal water and structural water in the same manner as in Example 1, and the results are shown in Table 1. The basic composite metal sulfate fiber had the following compositions.

(Example 2)

$$(Ni_{0.12}Mg_{0.88})_6(OH)_{9.96}(SO_4)_{1.02}\cdot 2.1H_2O.$$

(Example 3)

$$(Ni_{0.36}Mg_{0.64})_6(OH)_{10.08}(SO_4)_{0.96}\cdot 2.0H_2O.$$

EXAMPLE 4

Cobalt sulfate (0.025 mol) was dissolved in an aqueous solution containing 1.0 mol/l of magnesium sulfate, and then 30 g of a paste containing 2 g of a basic magnesium sulfate fiber and 12 g of magnesium hydroxide (the amount corresponding to 10 mol % based on the total molar amount of the magnesium sulfate and the cobalt sulfate) was added and homogeneously dispersed with a stirrer. The resultant slurry was placed in an autoclave having a volume of 3 liters, and hydrothermally treated at 170° C. for 12 hours. The reaction mixture was taken out, and filtered under reduced pressure, and the remainder was filtered/washed with water, and dried to give a basic composite metal sulfate fiber. The so-obtained basic composite metal sulfate fiber was measured for a crystal phase, an average diameter, an average length and temperatures of dehydration of crystal water and structural water in the same manner as in Example 1, and the results are shown in Table 1. The basic composite metal sulfate fiber had the following composition.

$(Co_{0.09}Mg_{0.91})_6(OH)_{9.98}(SO_4)_{1.01}\cdot 2.2H_2O$.

EXAMPLE 5

Zinc sulfate (0.012 mol) was dissolved in an aqueous solution containing 1.5 mol/l of magnesium sulfate, and then 2 g of a basic magnesium sulfate fiber and 29.1 g of a magnesium hydroxide powder (the amount corresponding to 16 mol % based on the total molar amount of the magnesium sulfate and the zinc sulfate) were added and homogeneously dispersed with a stirrer. The resultant slurry was placed in an autoclave having a volume of 3 liters, and hydrothermally treated at 170° C. for 5 hours. The reaction mixture was taken out, and filtered under reduced pressure, and the remainder was washed with water, dehydrated and dried to give a basic composite metal sulfate fiber. The so-obtained basic composite metal sulfate fiber was measured for a crystal phase, an average diameter, an average length and temperatures of dehydration of crystal water and structural water in the same manner as in Example 1, and the results are shown in Table 1. The basic composite metal sulfate fiber had the following composition.

$(Zn_{0.02}Mg_{0.98})_6(OH)_{9.98}(SO_4)_{1.01}\cdot 2.8H_2O$.

EXAMPLE 6

Cupric sulfate (0.03 mol) was dissolved in an aqueous solution containing 1.5 mol/l of magnesium sulfate, and then 4 g of a basic magnesium sulfate fiber and 35 g of a magnesium hydroxide powder (the amount corresponding to 20 mol % based on the total molar amount of the magnesium sulfate and the cupric sulfate) were added and homogeneously dispersed with a stirrer. The resultant slurry was placed in an autoclave having a volume of 3 liters, and hydrothermally treated at 180° C. for 4 hours. The reaction mixture was taken out, and filtered under reduced pressure, and the remainder was washed with water, dehydrated and dried to give a basic composite metal sulfate fiber. The so-obtained basic composite metal sulfate fiber was measured for a crystal phase, an average diameter, an average length and temperatures of dehydration of crystal water and structural water in the same manner as in Example 1, and the results are shown in Table 1. The basic composite metal sulfate fiber had the following composition.

$(Cu_{0.05}Mg_{0.95})_6(OH)_{9.9}(SO_4)_{1.05}\cdot 2.0H_2O$.

EXAMPLE 7

2 Liters of an aqueous solution containing 1.5 mol/l of magnesium sulfate was placed in an autoclave having a volume of 3 liters, and dissolved oxygen was purged by blowing in a nitrogen gas. Further, while a nitrogen gas was blown in, 0.023 mol of ferrous sulfate was dissolved, and 3 g of a basic magnesium sulfate fiber and 18.2 g of a magnesium hydroxide powder (the amount corresponding to 15 mol % based on the total molar amount of the magnesium sulfate and the ferrous sulfate) were added and homogeneously dispersed with a stirrer. Then, the resultant slurry was hydrothermally treated under a nitrogen atmosphere at 150° C. for 15 hours. The reaction mixture was taken out, and filtered, and the remainder was washed with water, dehydrated and dried to give a basic composite metal sulfate fiber. The so-obtained basic composite metal sulfate fiber was measured for a crystal phase, an average diameter, an average length and temperatures of dehydration of crystal water and structural water in the same manner as in Example 1, and the results are shown in Table 1. The basic composite metal sulfate fiber had the following composition.

$(Fe_{0.04}Mg_{0.96})_6(OH)_{10.2}(SO_4)_{0.9}\cdot 1.9H_2O$.

EXAMPLE 8

Example 7 was repeated except that the ferrous sulfate was replaced with manganese sulfate to give a basic composite metal sulfate fiber. The basic composite metal sulfate fiber was measured for a crystal phase, an average diameter, an average length and temperatures of dehydration of crystal water and structural water in the same manner as in Example 1, and the results are shown in Table 1. The basic composite metal sulfate fiber had the following composition.

$(Mn_{0.04}Mg_{0.96})_6(OH)_{9.9}(SO_4)_{1.05}\cdot 2.0H_2O$.

COMPARATIVE EXAMPLE 1

Nickel sulfate (0.6 mol) was dissolved in 2 liters of an aqueous solution containing 1.0 mol/l of magnesium sulfate, and then 3 g of a basic magnesium sulfate fiber and 26.3 g of a magnesium sulfate powder (the amount corresponding to 17 mol % based on the total molar amount of the magnesium sulfate and the nickel sulfate) and homogeneously stirred with a stirrer. The resultant slurry was treated in the same manner as in Example 1 to obtain a reaction product, and the reaction product was treated in the same manner as in Example 1. The measurement results thereof are shown in Table 1. The reaction product had the following composition.

$(Ni_{0.55}Mg_{0.45})_6(OH)_{11.1}(SO_4)_{0.45}\cdot mH_2O$

CONTROL EXAMPLE 1

26.3 Grams of a magnesium hydroxide powder was added to 2 liters of an aqueous solution containing 1.5 mol/l of magnesium sulfate (the amount of the magnesium hydroxide corresponded to 15 mol % based on the molar amount of the magnesium sulfate), and homogeneously stirred with a stirrer. The resultant slurry was treated in the same manner as in Example 1 to obtain a reaction product, and the reaction product was treated in the same manner as in Example 1. The measurement results thereof are shown in Table 1. The reaction product had the following composition.

$Mg_6(OH)_{9.98}(SO_4)_{1.01}\cdot 2H_2O$

COMPARATIVE EXAMPLE 2

Nickel sulfate (0.05 mol) was dissolved in an aqueous solution containing 0.5 mol/l of magnesium sulfate, and then 3 g of a basic magnesium sulfate fiber and 33.7 g of a magnesium hydroxide powder (the amount corresponding to 55 mol % based on the total amount of the magnesium sulfate and the nickel sulfate) were added and homogeneously dispersed with a stirrer. The resultant slurry was treated in the same manner as in Example 1 to obtain a reaction product, and the reaction product was treated in the same manner as in Example 1. The measurement results thereof are shown in Table 1. The reaction product had the following composition.

$$(Ni_{0.09}Mg_{0.91})_6(OH)_{10.76}(SO_4)_{0.62}\cdot mH_2O$$

EXAMPLE 9

Nickel sulfate (0.03 mol) and 0.01 mol of zinc sulfate were dissolved in an aqueous solution containing 1.5 mol/l of magnesium sulfate, and then 2 g of a basic magnesium sulfate fiber and 29.6 g of a composite metal hydroxide powder ($Zn_{0.02}Mg_{0.98}(OH)_2$, the amount corresponding to 16.5 mol % based on the total amount of the magnesium sulfate, the nickel sulfate and zinc sulfate) were added and homogeneously stirred with a stirrer. The resultant slurry was treated in the same manner as in Example 1 to obtain a reaction product, and the reaction product was treated in the same manner as in Example 1. The measurement results thereof are shown in Table 1. The reaction product had the following composition.

$$(Ni_{0.05}Zn_{0.02}Mg_{0.93})_6(OH)_{9.9}(SO_4)_{1.05}\cdot 2H_2O$$

TABLE 1

| *1 Example | Temperature of crystal water dehydration (°C.) | Temperature of structural water dehydration (°C.) | *2 Average diameter of fiber (μ) | *2 Average length of fiber (μ) | *3 Powder X-ray diffraction |
|---|---|---|---|---|---|
| Ex-1 | 335 | 443 | 0.7 | 60 | A |
| Ex-2 | 340 | 437 | 0.4 | 70 | A |
| Ex-3 | 342 | 405 | 0.2 | 40 | A |
| Ex-4 | 339 | 432 | 0.5 | 50 | A |
| Ex-5 | 337 | 442 | 0.6 | 70 | A |
| Ex-6 | 337 | 434 | 0.7 | 100 | A |
| Ex-7 | 358 | 434 | 0.3 | 20 | A |
| Ex-8 | 335 | 435 | 0.4 | 50 | A |
| CEx-1 | 325 | 433 | PA | PA | B |
| CNEx-1 | 333 | 445 | 0.5 | 30 | A |
| CEx-2 | — | — | PA | PA | D |
| Ex-9 | 342 | 433 | 0.3 | 40 | A |

*1 Ex = Example, CEx = Comparative Example, CNEx = Control Example
*2 PA = particulate
*3 A: X-ray diffraction peak of a powder is substantially the same as that of basic mangesium sulfate.
B: X-ray diffraction peak of a powder is separated into peaks of $Ni(OH)_2$ and basic mangesium sulfate.
C: X-ray diffraction peak of a powder is separated into peaks of CuO and basic mangesium sulfate.
D: X-ray diffraction peak of a powder is separated into peaks of $Mg(OH)_2$ and basic mangesium sulfate.

EXAMPLES 10–12

The basic composite metal sulfate fibers obtained in Examples 1, 5 and 6 were respectively surface-treated by a wet method using 2% sodium oleate, and shaped into cylindrical granulated products having a diameter of 4 mm with a kneader and an extruder, and the cylindrical granulated products were dried.

2.0 Kilograms of a polypropylene resin, 0.03 g of Irganox 1010 (phenolic antioxidant, supplied by Merck Japan) and 0.03 g of weston 626 (phosphor-containing antioxidant) were mixed with 900 g of each of the above cylindrical granulated products, and the mixtures were respectively melted and extruded at 220° C. with a twin-screw extruder to obtain pellets. The pellets from each granulated product were dried under vacuum at 100° C. for 1 hour, and then injection-molded at 220° C. to give test pieces. The test pieces were evaluated on tensile strength and elongation (JIS K-7113), flexural strength and elastic modulus (JIS K-7203), appearance (visual examination) and combustibility (UL-94-VE, a thickness of ⅛ inch). Table 2 shows the results.

CONTROL EXAMPLE 2

The same polypropylene as that used in Example 10 was injection-molded in the same manner as in Example 10, and the resultant test pieces were evaluated in the same manner as in Example 10. Table 2 shows the results.

EXAMPLE 13

The basic composite metal sulfate fiber obtained in Example 9 was surface-treated by a wet method using 2% sodium stearate, and shaped into a cylindrical granulated product having a diameter of 4 mm with a kneader and an extruder, and the cylindrical granulated product was dried.

The above-obtained granulated product, magnesium hydroxide surface-treated with 1% sodium oleate and a polypropylene resin were mixed in a weight ratio of 20:35:45, and melted and extruded with a twin-screw extruder to give pellets. The pellets were dried under vacuum at 100° C. for 1 hour, and then injection-molded at 230° C. to prepare test pieces. The test pieces were evaluated in the same manner as in Example 10. Table 2 shows the results.

COMPARATIVE EXAMPLE 3

The basic magnesium sulfate fiber obtained in Control Example 1 was surface-treated by a wet method using 2% sodium stearate, and shaped into a cylindrical granulated product in the same manner as in Example 13. Then, test pieces were prepared in the same manner as in Example 13 except that the above-obtained granulated product was used in place of the granulated product of the basic composite metal sulfate fiber. The test pieces were evaluated in the same manner as in Example 10. Table 2 shows the results.

COMPARATIVE EXAMPLE 4

Example 13 was repeated except that the basic composite metal sulfate fiber of the present invention was not used and that the magnesium hydroxide:polypropylene mixing ratio was changed to 58:42 to give test pieces. The test pieces were evaluated in the same manner as in Example 10. Table 2 shows the results.

TABLE 2

| *1 Example | *2 Tensile strength | *3 Tensile elongation at break | *2 Flexural strength | *2 Flexural modulus | Appearance | Combustibility |
|---|---|---|---|---|---|---|
| Ex-10 | 327 | 140 | 560 | 630 | excellent | out of standard |
| Ex-11 | 330 | 132 | 573 | 642 | excellent | out of standard |
| Ex-12 | 342 | 150 | 587 | 675 | excellent | out of standard |
| CNEx-2 | 280 | 660 | 335 | 100 | excellent | out of standard |
| Ex-13 | 256 | 40 | 459 | 764 | excellent | V-O |
| CEx-3 | 246 | 38 | 440 | 490 | flash pattern | out of stan- |

TABLE 2-continued

| *1 Example | *2 Tensile strength | *3 Tensile elongation at break | *2 Flexural strength | *2 Flexural modulus | Appearance | Combustibility |
|---|---|---|---|---|---|---|
| CEx-4 | 190 | 42 | 387 | 388 | excellent | dard V-O |

*1: Ex = Example, CEx 32 Comparative Example, CNEx = Control Example
*2: unit = $Kg/cm^2$
*3: unit = %

As specified above, the present invention provides a novel basic composite metal sulfate fiber and a resin and/or rubber composition containing the basic composite metal sulfate fiber. Further, the present invention provides a novel resin and/or rubber composition capable of giving a molded article improved in mechanical strength and flame retardancy. Furthermore, the present invention provides a novel resin and/or rubber composition capable of giving a molded article having an excellent appearance.

What is claimed is:

1. A basic composite metal sulfate fiber having the formula (1), $$(Mg_{1-x}M^{2+}{}_x)_6(OH)_{12-2y}(SO_4{}^{2-})_y mH_2O \quad (1)$$

wherein M is at least one metal selected from the group consisting of Mn, Fe, Co, Ni, Cu and Zn, and x, y and m are respectively defined by $0.005<x<0.5$, $0.8<y<1.2$ and $0<m<4$.

2. A basic composite metal sulfate fiber according to claim 1, which has a diameter of 0.01 to 10 μm, a length of 5 to 1,000 μm, and an aspect ratio of at least 50.

3. A resin and/or rubber composition containing 100 parts by weight of a resin and/or a rubber and approximately 1 to 100 parts by weight of the basic composite metal sulfate fiber recited in claim 1.

4. A process for the production of the basic composite metal sulfate fiber recited in claim 1, which comprises adding at least one alkali selected from the group consisting of $Mg(OH)_2$, MgO, ammonia and alkali metal hydroxide to a mixed aqueous solution containing magnesium sulfate and sulfate of at least one divalent metal selected from the group consisting of Mn, Fe, Co, Ni, Cu and Zn, the amount of the alkali(s) being not more than approximately 50 mol % based on the total molar weight of the magnesium sulfate and the divalent metal(s), and allowing the resultant mixture to hydrothermally react approximately at a temperature between 110° C. and 300° C.

5. A process according to claim 4, wherein the hydrothermal reaction is carried out in the presence of at least one of a basic magnesium sulfate fiber and the basic composite metal sulfate fiber recited in claim 1.

6. A process according to claim 4, wherein the alkali further contains a composite metal hydroxide of the formula, $$Mg_{1-z}M^{2+}{}_z(OH)_2 \quad (2)$$

wherein M has the same meaning as that of M in the formula (1) and z is defined by $0.005<z<0.9$.

7. A process according to claim 6, wherein the hydrothermal reaction is carried out in the presence of at least one of a basic magnesium sulfate fiber and the basic composite metal sulfate fiber recited in claim 1.

* * * * *